United States Patent [19]

Swain

[11] 3,986,427

[45] Oct. 19, 1976

[54] APPARATUS AND METHOD FOR PRODUCING CHORDAL MUSIC

[76] Inventor: Gene L. Swain, 2115 Skyhawk Drive, Fort Wayne, Ind. 46805

[22] Filed: Aug. 5, 1974

[21] Appl. No.: 494,628

[52] U.S. Cl. ..... 84/377

[51] Int. Cl.[2] ..... G10D 7/12

[58] Field of Search ..... 84/375, 377, 317, 443

[56] References Cited

UNITED STATES PATENTS

| | | | |
|---|---|---|---|
| 2,478,963 | 8/1949 | Bibus | 84/377 |
| 2,496,511 | 2/1950 | Abbott | 84/377 |
| 2,655,068 | 10/1953 | Ruben | 84/377 |
| 2,827,818 | 3/1958 | Bibus | 84/377 |
| 3,001,434 | 9/1961 | Loduca | 84/443 |
| 3,149,527 | 9/1964 | Kraft | 84/377 |
| 3,837,255 | 9/1974 | Starns et al. | 84/317 |

*Primary Examiner*—John Gonzales

[57] ABSTRACT

An apparatus and a method are provided for the producing of chordal music. The apparatus includes an elongated tone chamber body of the harmonica type having a plurality of reed-type chambers each including a port. The tone chamber body is slidably inserted into an elongated housing that includes a valve block having a row of air passages spaced to register with the ports of the tone chamber body.

Chordal pattern means is provided for blocking and for selectively opening a plurality of the air passages in predetermined chordal patterns. A keynote selection means is provided for manually positioning the tone chamber body and one of the tone chambers therein in registry with one of the air passages of the valve block in order to select a keynote for the predetermined chordal pattern. Cross-indexing means, for selecting a plurality of notes in a chromatic scale and for activating the selected notes, is provided by the spacing of the ports, the spacing of the passages, the pattern of open valves, the relative positioning of the tone chamber body with the housing to select a keynote for the selected chordal pattern, and the resultant registry of a plurality of the tone chambers with a plurality of the open valves.

The method includes manually selecting one of a plurality of predetermined chord patterns, manually selecting a note from a chromatic scale for the keynote of the selected chordal pattern, and cross-indexing the selected chordal pattern with the selected keynote to select a plurality of notes in the chromatic scale which correspond to the selected chordal pattern of the keynote and to activate a plurality of tone-producing chambers corresponding to the selected notes.

22 Claims, 23 Drawing Figures

APPARATUS AND METHOD FOR PRODUCING CHORDAL MUSIC

BACKGROUND OF THE INVENTION

1. Field of the Invention

This invention relates generally to an apparatus and a method for producing chordal music and more particularly to a harmonica-type instrument having a plurality of chord-selecting keys for selection of one of a plurality of predetermined chordal patterns and a keyblock for determining the keynote of the selected chordal pattern, the invention including both the apparatus and the method of producing chordal music.

2. Description of the Prior Art

Harmonicas, or mouth organs, are a commmon type of musical instrument utilizing metallic reeds for the production of musical notes. Harmonicas are built in a wide range of sizes and qualities from those which are manufactured for toys to more elaborate and precision built instruments. When produced as a toy, the harmonica usually utilizes the diatonic scale since the use of this scale greatly reduces the number of reed-type tone chambers which are required and thus the length and cost of the instrument is greatly reduced. Harmonicas which are produced for use as precision musical instruments generally utilize the chromatic scale which greatly increases the length and the cost over that of the toy harmonicas utilizing the diatonic scale.

Harmonicas typically include two rows of reed-type tone-producing chambers. One of these rows of reed-type chambers is adapted for producing sound when air is supplied from the mouthpiece to the reed by the musician blowing into the mouthpiece. The other row of reed-type tone chambers is actuated by the musician pulling air into his mouth from the mouthpiece and the reed-type tone chambers.

The notes to be played are selected by placing the mouth over a portion of the mouthpiece corresponding to the notes to be played and by blocking off passages leading to unwanted notes with the tongue. While it is possible, for a person greatly skilled in the playing of the harmonica, to produce good music from the harmonica, the intricacy of the music to be played is severely limited by the requirement of selecting the notes by positioning of the mouth and the tongue over the mouthpiece.

In contrast to prior art, the present invention provides a harmonica-type instrument in which any of ten different chordal patterns may be placed in any of twelve keys or tonal steps by even an inexperienced musician.

SUMMARY OF THE INVENTION

In accordance with the broader aspects of this invention, there is provided a musical sound-producing apparatus which includes a plurality of tone-producing elements or chambers for producing notes in a chromatic scale, a chordal pattern means for selecting one of a plurality of predetermined chordal patterns, keynote selection means for manually selecting one note from a chromatic scale for the keynote of the chordal pattern, and cross-indexing means including the keynote selection means and the chordal pattern means for selecting and for activating a plurality of the elements or chambers corresponding to the selected chordal pattern and the selected keynote.

In a preferred embodiment of the invention, the apparatus comprises a tone chamber body of the harmonica type having a plurality of reed-type tone chambers and being slidably inserted into a housing, a chordal pattern means which includes air valves controlling the flow of air through a plurality of passages, a plurality of chord keys which open the air valves in a plurality of predetermined chordal patterns, a keynote selection means which includes a stepped valve block for positioning the tone chamber body with respect to the preselected chordal pattern and thereby selects the keynote of the chord to be played, and cross-indexing means which includes the relative positioning of the tone chamber with the predetermined chordal pattern and the open valves thereof.

The method includes manually selecting one of a plurality of predetermined chordal patterns, manually selecting a note from a chromatic scale for the keynote of the selected chrodal pattern, and cross-indexing the selected chordal pattern with the keynote to select a plurality of notes in the chromatic scale corresponding to the selected pattern and to the keynote. When applied to a harmonica, the method includes manipulating a keyblock with one hand for selecting the keynote, manipulating one or more chord keys with the other hand for selecting the chordal pattern, and actuating the selected keynote and the notes corresponding to the selected chordal pattern by blowing air into or drawing air out of a mouthpiece.

It is an object of this invention to provide an apparatus and a method for playing musical chords.

It is another object of this invention to provide an apparatus for manually selecting one of a plurality of predetermined chordal patterns, for manually selecting the keynote of the selected chordal pattern, and for cross-indexing the selected chordal pattern with the selected keynote to select notes in a chromatic scale corresponding to the selected chordal pattern and the selected keynote.

It is still another object of this invention to provide a method for the producing of chordal music in which one of a plurality of predetermined chordal patterns are selected with the fingers of one hand and the keynote for the selected chordal pattern is selected with the fingers of the other hand.

It is a further object of this invention to provide a harmonica-type instrument having a plurality of chord keys at one end of the instrument for the selection of one of a plurality of predetermined chordal patterns, and a stepped keyblock at the other end of the instrument for the selection of one keynote from a chromatic scale for the keynote of the selected chordal pattern.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

In the drawings:

FIG. 17*a* for a major chord;

FIG. 17*b* for a sixth chord when activated in conjunction with a major or minor chord bar;

FIG. 17*c* for a minor chord;

FIG. 17*d* for a flatted seventh chord;

FIG. 17*e* for an augmented chord; and FIG. 17*f* for a diminished chord;

DESCRIPTION OF THE PREFERRED EMBODIMENT

Figure 1:
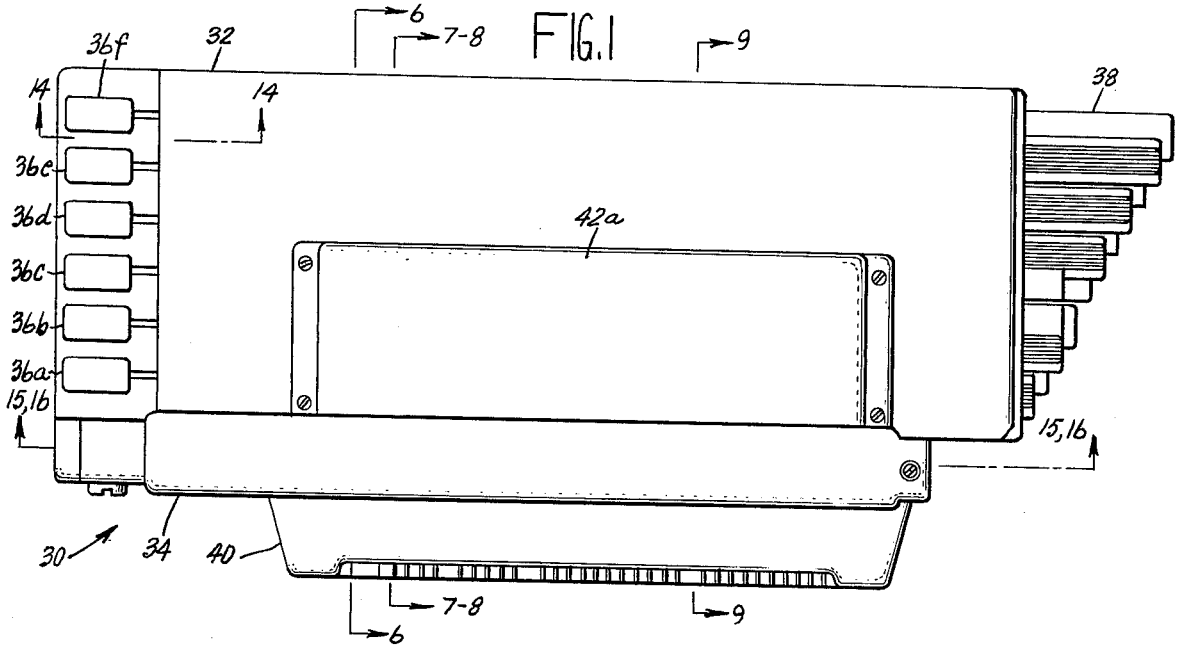
FIG. 1 is a top plan view of the musical apparatus.
Figure 2:
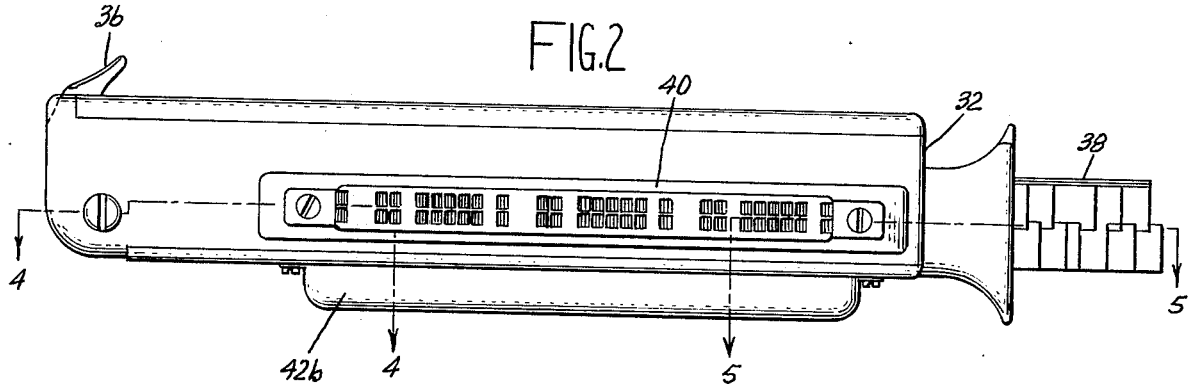
FIG. 2 is a front view of the apparatus.
Figure 3:
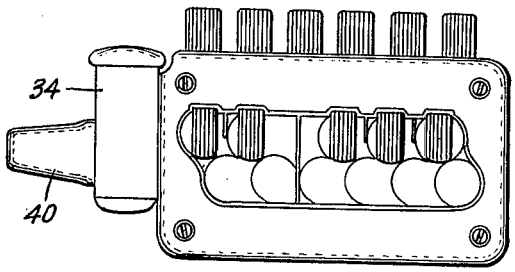
FIG. 3 is a right-end view of the apparatus.

Referring now to FIGS. 1 to 3, a musical apparatus 30 of plastic and/or metal components as desired includes a housing 32 having a valve block portion 34, a plurality of chord keys 36*a*–36*f*, a keyblock 38, a mouthpiece 40, and a pair of cover plates 42a and 42b.

Figures 4, 5:
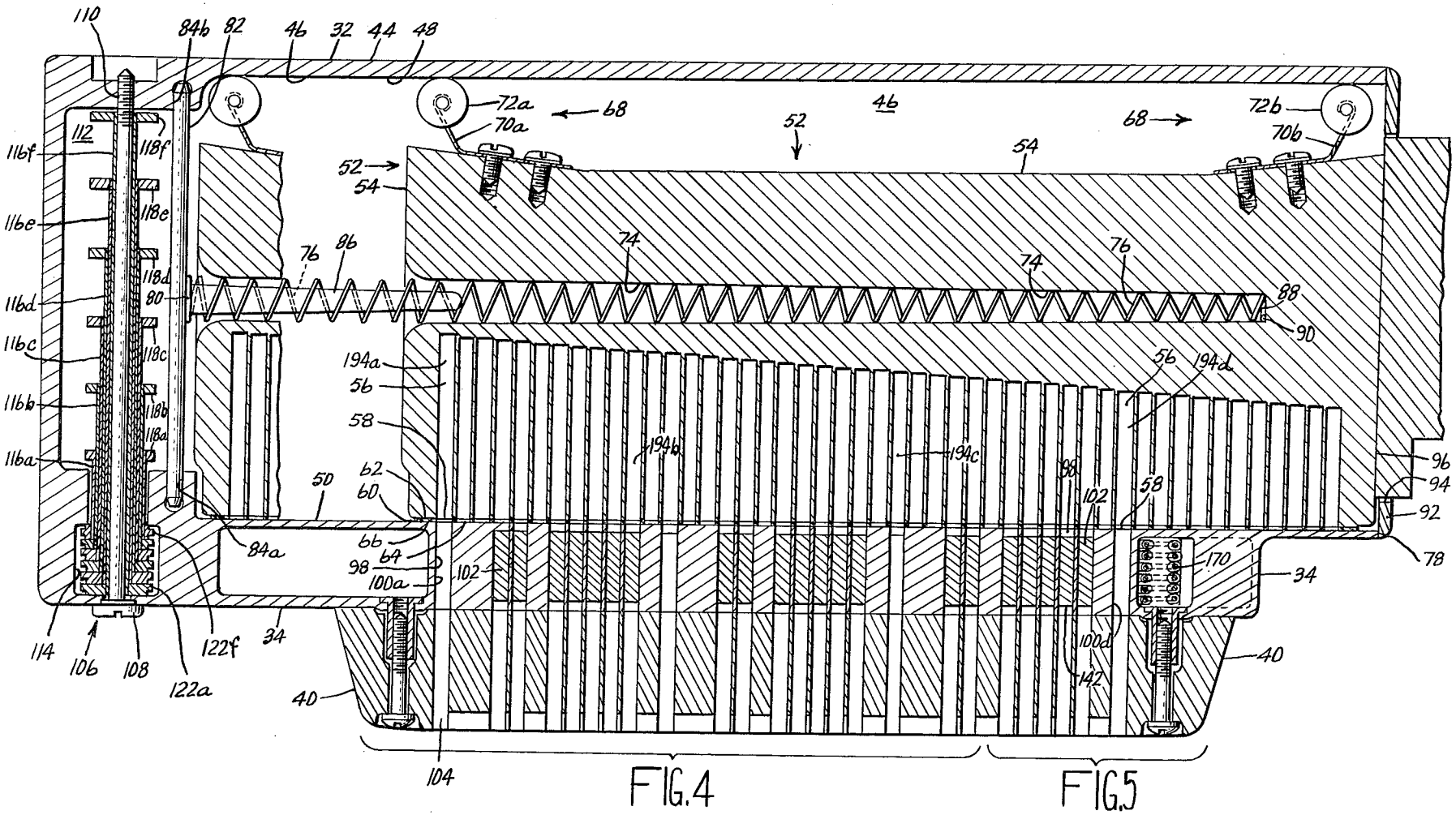
FIG. 4 is a cross-section taken substantially along section line 4—4 of FIG. 2, showing a longitudinal cross-section of the left end of the apparatus.
FIG. 5 is a cross-section taken substantially along section line 5—5 of FIG. 2, showing a longitudinal cross-section of the portion of the apparatus which includes the keyblock.

Referring now to FIG. 4, the left end of the apparatus 30 is shown in cross section. The housing 32 includes a thickened front edge wall or valve block portion 34, a rear edge wall 44, a cavity 46 which includes an inner wall surface 48 of the rear edge wall 44, and an inner wall surface or indexing surface 50 of the front edge wall or valve block portion 34.

A tone chamber body assembly 52 is slidably inserted into the cavity 46. The tone chamber body assembly 52 includes a tone chamber body 54 having a plurality of tone chambers 56 each having an opening 58 which opens through a front edge surface 60 of the tone chamber body 54.

Figure 6:
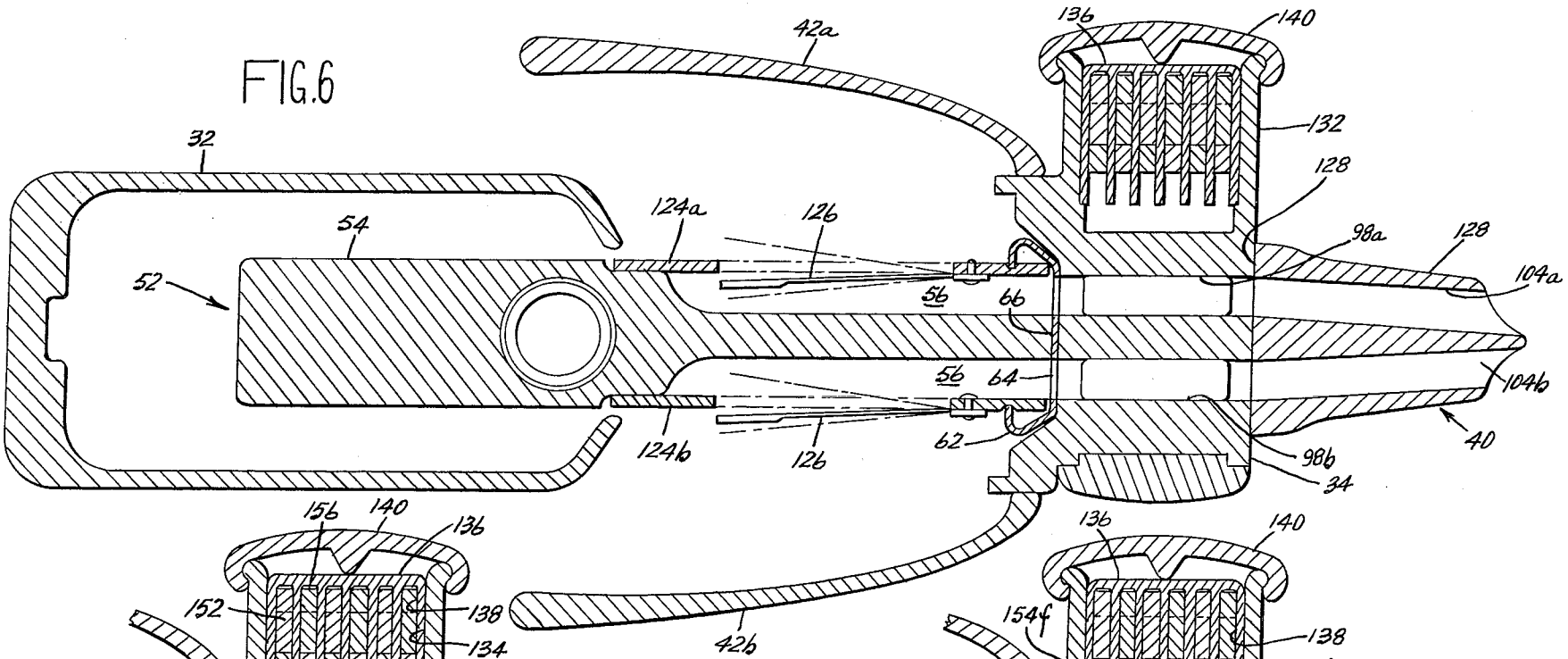
FIG. 6 is a cross-section taken substantially along the section line 6—6 of FIG. 1 showing one keynote passage.
Figure 11:
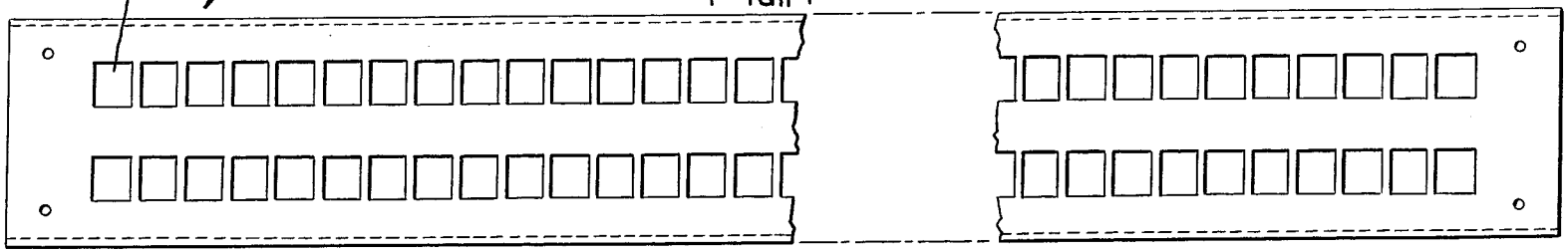
FIG. 11 is a front view of a portion of the indexing plate of FIG. 10.
Figure 10:
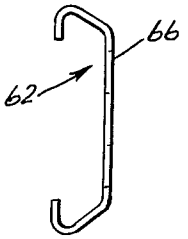
FIG. 10 is an end view of the indexing plate which is seen in cross-section of FIGS. 6–9.

Referring now to FIGS. 4, 5, 6, 10 and 11, tone chamber body assembly 52 of FIG. 4 includes an indexing plate 62 which is best seen in FIGS. 6, 10 and 11. The indexing plate 62 is attached to the tone chamber body 54 and includes a plurality of ports 64 which register with the openings 58 in the tone chamber body 54. The indexing plate 62 includes an indexing surface 66 which is held in air-sealing engagement with the indexing surface 50 by a spring device 68 (FIGS. 4, 5) which includes a pair of leaf springs 70*a* and 70*b* and a pair of wheels or rollers 72*a* and 72*b* being rotationally mounted to the leaf springs 70*a* and 70*b*. The wheels 72 provide minimal friction rolling movement against the inner wall surface 48 and the leaf springs 70 hold the indexing surface 66 against the indexing surface 50.

Referring now to FIGS. 4 and 5, the tone chamber body 54 includes a tapered spring chamber 74 disposed longitudinally therein for the receiving of a tapered, helical, compression spring 76 which urges the tone chamber body 54 toward an open end 78 of the housing 32. An end 80 of the spring 76 is abutted against and is restrained by a plate 82 which is anchored in a pair of notches 84*a* and 84*b* in the housing 32. A conically shaped guide rod 86 is attached to the plate 82 and provides guiding for and prevents buckling of the spring 76.

An end 88 of the spring 76 presses against bottom 90 of the spring chamber 74 to urge the tone chamber body 54 through the open end 78 of the housing 32. An end plate 92 having an opening 94 is attached to the open end 78 of the housing 34 and prevents movement of the tome chamber body 54 out of the cavity 46: the end 96 of the tone chamber body 54 is larger in cross-section than the opening 94 in the end plate 92, hence abuts against the latter.

The keyblock 38 is attached to the end 96 of the tone chamber body 54 and is of a smaller cross-section than the opening 94 in the end plate 92; so that the keyblock 38 can be moved into the cavity 46 to relatively position the indexing surfaces 50 and 66.

The valve block portion 34 includes a plurality of parallel disposed passages 98 opening orthogonally through the indexing surface 50 and spaced to register with the tone chambers 56 in body 54. The passages 98 are arranged in groups of eight, spaced as shown, and include a first or keynote passage 100 in each group of eight, the first of these keynote passages, 100*a*, being seen in FIG. 4 and the fourth and last of these keynote passages, 100*d*, being seen in FIG. 5. All of the passages 98, except for the keynote passages 100, include an air valve or slide valve 102 interposed therein for the control of air flow through the passages 98. A more detailed description of the slide valves 102 and a more detailed description of the arrangement of the passages 98 will be included along with the description of other figures.

Figure 14:
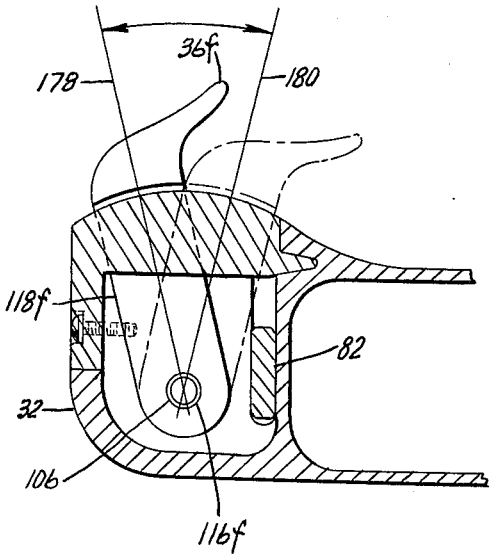
FIG. 14 is a cross-section taken substantially along section line 14—14 of FIG. 1 showing chord keys mounted to torsion tubes.

Referring now to FIGS. 4 and 14, but primarily to FIG. 4, a pivot bolt or pivot shaft 106 is mounted in the housing 32 and is with a head 108 abutted against surface 34 and end 110 threaded into the rear housing wall 44. The pivot shaft 106 spans a key arm chamber 112 and a cam arm chamber 114. A plurality of torsion tubes 116*a*–116*f* are telescopically mounted over the pivot shaft 106 for rotational movement about the pivot shaft 106 and each other. A plurality of key arms 118a–118f are connected respectively to one end of each of the torsion tubes 116a–116f, the key arm 118f being more clearly seen in FIG. 14. Each of the key arms 118 includes one end which is connected to its respective torsion tube 116 and another end which includes one of the keys 36.

Referring now to FIG. 4, it can be seen that the torsion tube 116f is the longest and the smallest in diameter and is fitted directly over the pivot shaft 106 for rotational movement therearound. The other of the torsion tubes 116 are larger in diameter and shorter in length, respectively, so that all fit together coaxially and so that both ends of all are accessible.

Figure 15:
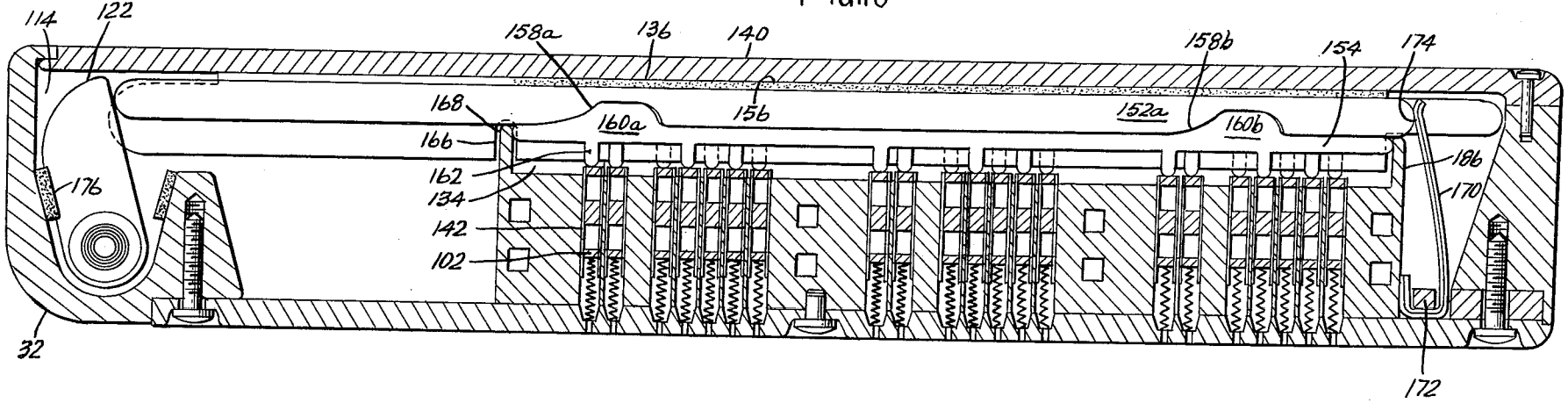
FIG. 15 is a partial cross-section taken substantially along section line 15—15 of FIG. 1, showing all slide valves in their passage-blocking positions.
Figure 16:
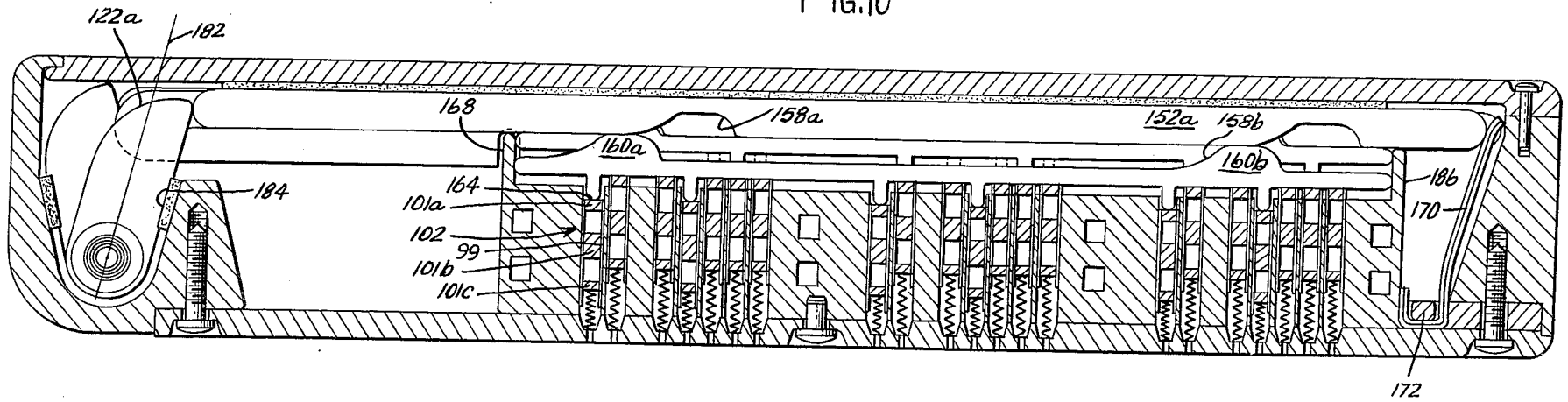
FIG. 16 is a partial cross-section taken substantially along section line 16—16 of FIG. 1, showing one slide bar actuated to the right and a plurality of air valves opened by downward movement of one of the chord bars.

Referring now to FIGS. 4, 15 and 16, a plurality of cam arms 122 are provided, one end of each of the cam arms 122 being attached to one of each of the torsion tubes 116. The cam arms 122 can best be seen in FIGS. 15 and 16, FIG. 15 showing all of the cam arms 122 in their inactivated positions, and FIG. 16 showing one cam arm 122a in the activated position and the remainder of the cam arms 122 in their inactivated positions.

FIG. 6 shows a cross-sectional view of the housing 32 which includes the valve block portion 34, a cross-section of the tone chamber body assembly 52, the mouthpiece 40, and the cover plates 42a and 42b.

The tone chamber body assembly 52 includes the tone chamber body 54, the reed plate assemblies 124a and 124b which are of conventional construction, and the indexing plate 62 which also serves as a retaining plate for the reed-plate assemblies 124a and 124b by the engagement of the edges of plate 62 with elongated companion grooves in the reed-plate assemblies as shown.

The tone chamber body 54 includes two rows of the tone chambers 56, each tone chamber being shaped as shown in FIG. 6. The tone chambers 56 are of various lengths according to the particular note of the tone chamber and they are all spaced in closed parallel arrangement as shown in FIGS. 4 and 5.

Figure 18:
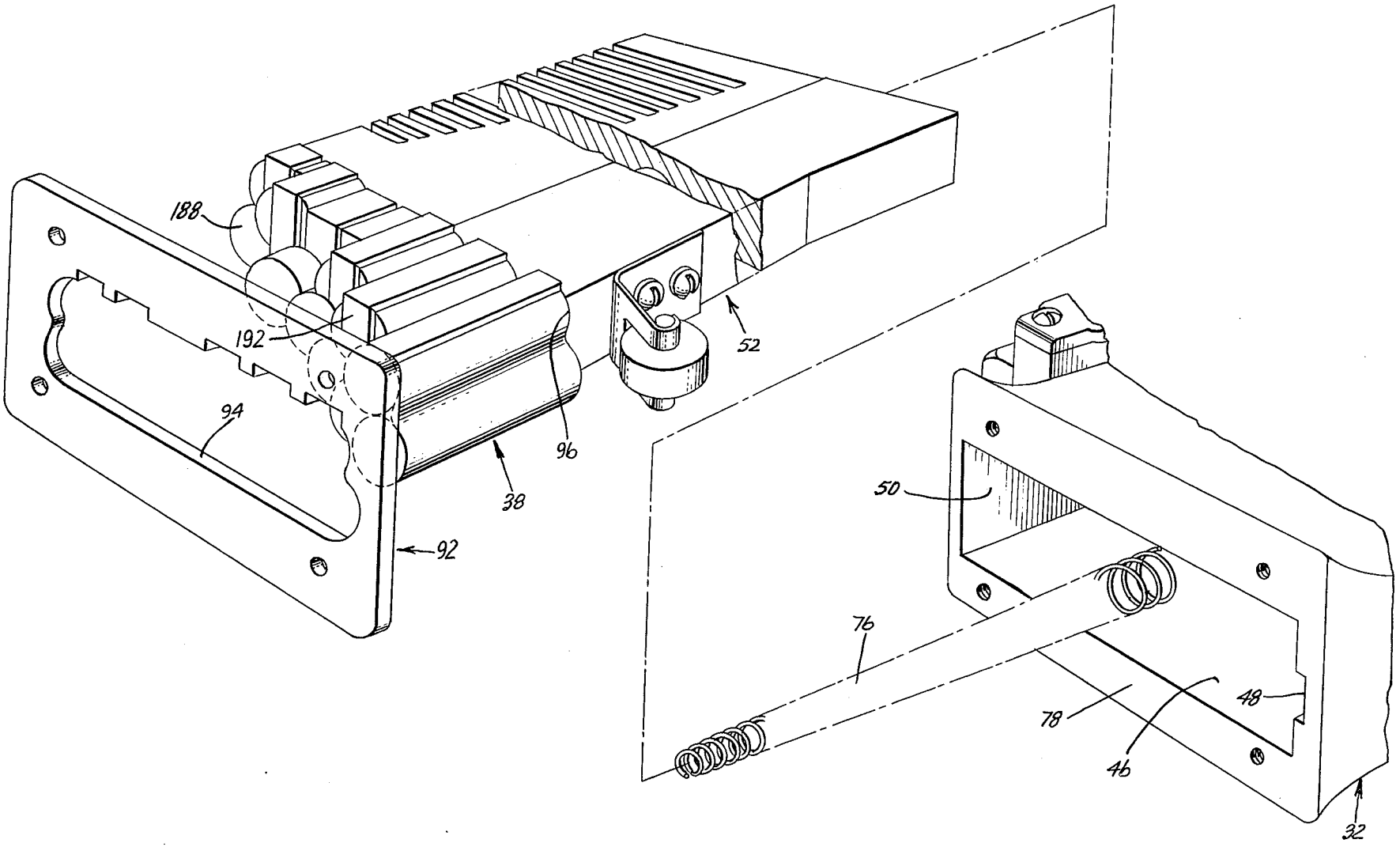
FIG. 18 is an exploded perspective view of the housing end plate, the keyblock and a portion of the tone chamber body, and a portion of the housing showing a substantially rectangular cavity therein.

Both of the reed-plate assemblies 124 include a plurality of metallic reeds 126, each of the metallic reeds being spaced to cooperate with one of the tone chambers 56, a portion of one of the reed plate assemblies 124 being more clearly seen in FIG. 18. One of the reed-plate assemblies 124 is positioned for movement of the metallic reeds 126 away from the tone chambers 56 and the other of the reed-plate assemblies is positioned for movement of the metallic reeds 126 into the tone chambers 56; so that, the reeds 126 of one of the reed-plate assemblies 124 is actuated by a supply of air in the tone chambers 56 moving past the reeds 126 to the outside of the tone chamber body 54; and the reeds 126 of the other reed-plate assemblies 124 are actuated by air moving from the outside of the tone chamber body 54, past the metallic reeds 126 and into the tone chambers 56. Thus the construction of the tone chamber body 54 with its tone chambers 56 and its reed-plate assemblies 124 is typical of harmonica-type instruments.

Figure 9:
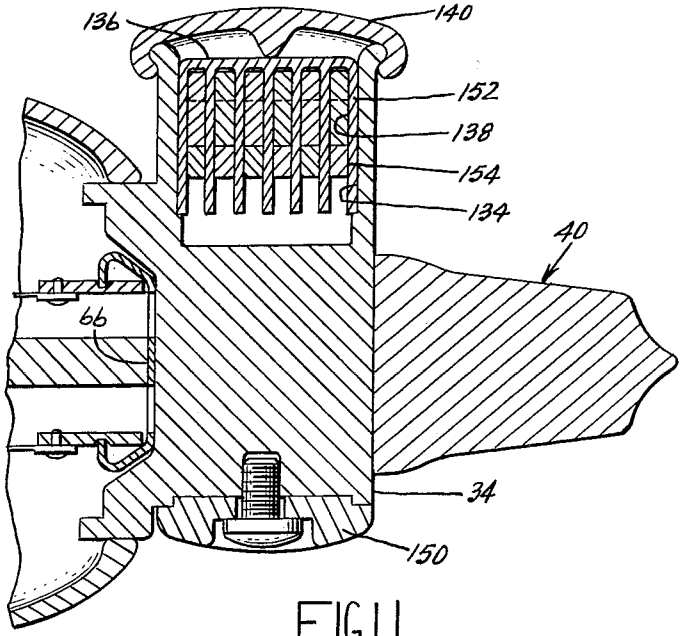
FIG. 9 is a partial cross-section taken substantially along section line 9—9 of FIG. 1, showing the construction of the valve block and the mouthpiece intermediate of the air passages.

Referring now to FIGS. 4, 5, 6, 9, 15 and 16, but primarily to FIG. 6, the mouthpiece 40 includes a plurality of passages 104 being disposed in two parallel rows which can best be seen by comparing FIGS. 4 and 5 with FIG. 6. One of these rows is designated as passage row 104a and the other row 104b. The mouthpiece 40 also includes a mouthpiece surface 128 which encloses passage rows 104a 104b and which is securely attached by means of screws or the like to a surface 132 of the valve block portion 34. FIG. 9 is a cross-section taken intermediate of the passages 104 of mouthpiece 40 and the passages 98 of the valve block portion 34.

The valve block portion 34 includes two rows of the passages 98 as can best be seen by comparing FIGS. 5 and 6. One of these rows is designated as row 98a and the other of these rows is designated as 98b. In each of the rows 98a and 98b, the first passage in each group of eight passages in a given row is open at all times from the mouthpiece passages 104 to the tone chambers 56. These passages which are always open have been previously designated as first passages or keynote passages 100. The reason that keynote passages 100 are always open is that, in operation of the instrument, the tone chamber body assembly 52 is positioned so that one of the tone chambers 56 is positioned to register with the keynote passage 104a, and the tone chamber 56 which is in registry with the keynote passage 104a is the keynote for the chord to be played. Since the chromatic scale is divided into twelve notes or tones, the keynote passages 100 and the spaces therebetween as shown are spaced to coincide with each group of twelve of the tone chambers 56, one of the keynote passages 100 being provided for each of the three groups of twelve spaces and one additional keynote passage 100 being provided in the thirty-seventh space.

Figure 7:
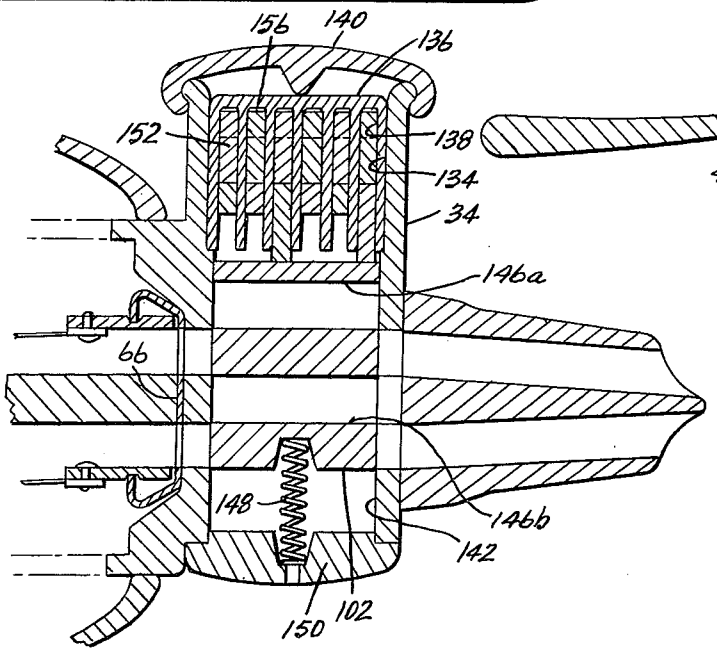
FIG. 7 is a partial cross-section taken substantially along section line 7—7 of FIG. 1, showing one slide valve in the closed position.
Figure 12:
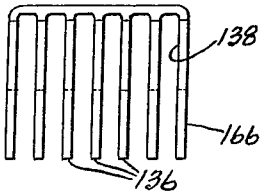
FIG. 12 is an end view of the retainer for the slide bars and the chord bars, being seen in cross-section in FIGS. 6–9.

Referring now to FIGS. 7, 9 and 15, the valve block portion 34 also includes an elongated chord and slide bar cavity 134 which can be seen in cross-section in FIGS. 7 and 9 and in longitudinal cross-section in FIG. 15. The cavity 134 extends longitudinally to and opens into the cam arm chamber 114. A chord and slide bar retainer 136 (also FIGS. 12 and 13) is installed into the cavity 134 and includes six chord and slide bar slots 138. A retaining cap 140 is attached to the valve block portion 34 to enclose and to retain the chord and slide bar retainer 136 in the cavity 134.

Figures 17, 17A, 17B, 17C, 17D, 17E, 17F:
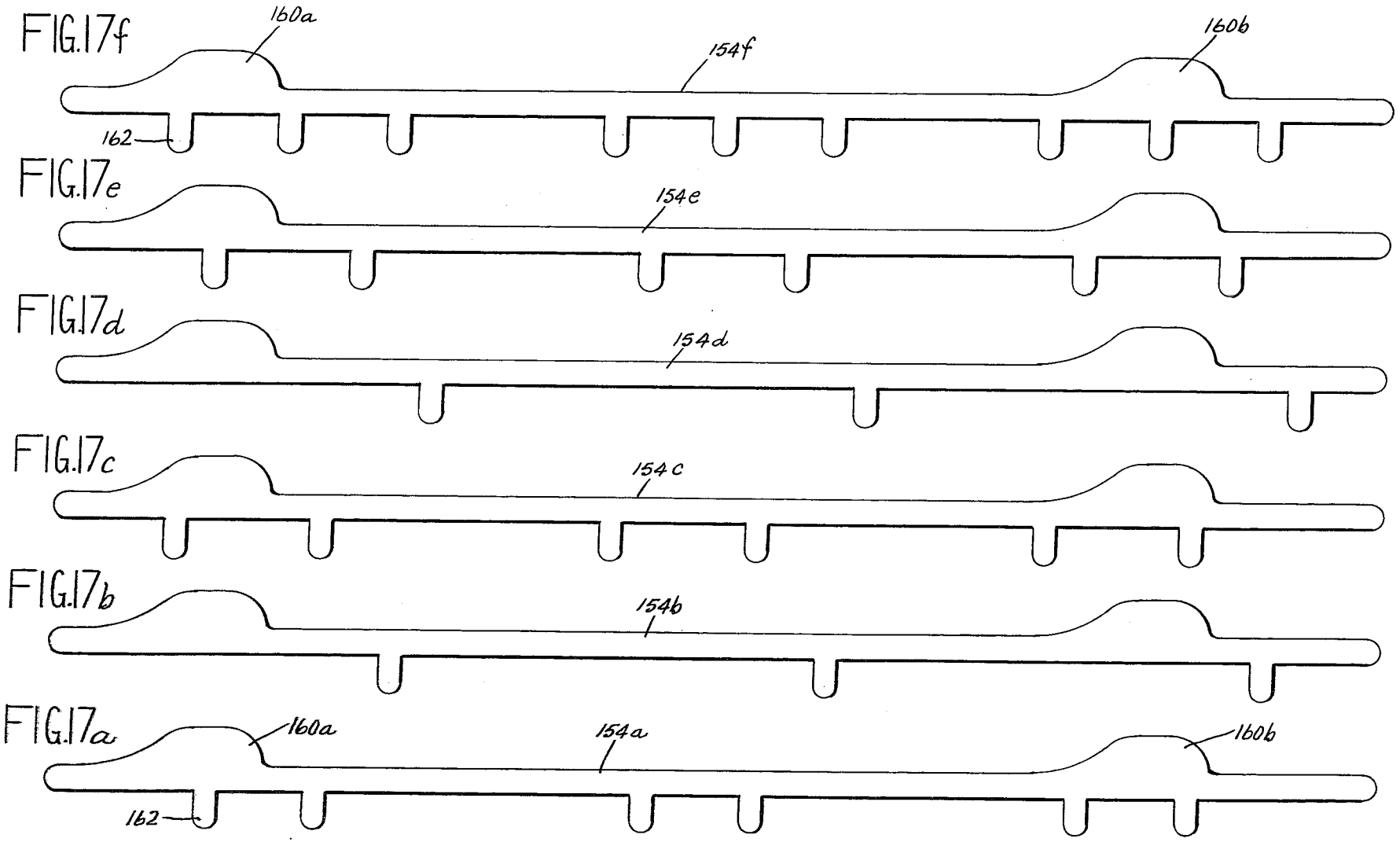
FIGS. 17*a*, 17*b*, 17*c*, 17*d*, 17*e* and 17*f* are front views of different chord bars.

A plurality of slide bars 152a–152f are each inserted into each of the slots 138 proximal to the retaining cap 140 and a plurality of chord bars 154a–154f (also see FIG. 17) are each inserted into one of the slots 138 proximal to one of the slide bars 152 and distal from the retaining cap 140, the slide bars 152 and chord bars 154 being shown in cross-section in FIGS. 7 and 9 and the slide bar 152a and the chord bar 154a being shown in plan view in FIG. 15.

Referring now to FIGS. 5, 7 and 15, the valve block portion 34 includes a plurality of valve cavities 142 each passing through the valve block portion 34 orthogonal to and intercepting the passages 98. Each of the valve cavities 142 is of generally rectangular cross-section as can be seen in FIGS. 5 and 7.

A slide valve 102 of generally rectangular cross-section is inserted into each of the valve cavities 142. Each of the slide valves 102 includes a pair of valve passages 146 which, when the slide valve 102 thereof is moved to an operating position, register with the passages 98 of the valve block portion 34 to provide free flow of air from the mouthpiece passages 104 to the registering ones of the tone chambers 56. Each of the slide valves 102 is spring loaded to a passage-blocking position by a spring 148 which is interposed between each of the slide valves 102 and a slide valve cap 150. One of the slide valves 102 is shown in the passage-occluding or blocking position in FIG. 7 and in its passage-opening position in FIG. 8.

More specifically, each valve block 102 is generally rectangular having a close sliding fit in the respective passage 98. It is composed of two parallel spaced, flat, thin, metal plates 99 having secured therebetween three rectangular blocks 101*a*, 101*b* and 101*c* in spaced parallel relation as shown to form the valve passages 146. The blocks 101 may be of wood, metal or plastic.

Referring now to FIGS. 7 and 15, the arrangement of the passages 98, the location of the slide valves 102, and both the construction and operation of the slide bars 152 and the chord bars 154 can be more clearly seen.

The passages 98, comprising the two rows of passages 98*a* and 98*b*, are disposed in the first of each twelve equal spaces and also in the fourth, fifth, seventh, eighth, ninth, tenth, and eleventh spaces. The first of these passages is one root keynote passage 100 and requires no slide valve as has previously been explained. The other of the passages 98 each include one of the slide valves 102.

The slide bars 152 are each stamped from metallic sheet stock and so include a pair of parallel faces which cooperate with the sides of the slide bar slots 138 to provide guided movement for the slide bars 152. The slide bars 152 also include a guide edge or surface 156 which slidably engages the bottom of the slots 138 to provide guided movement for the slide bars 152. Each of the slide bars 152 also includes a pair of cam recesses or cam means 158 in the opposite edge surface distal from the guide surface 156.

Each of the chord bars 154 (also see FIG. 17) is stamped from a sheet of metal and so includes a pair of parallel faces which cooperate with the sides of the slots 138 to be slidably guided thereby. Each of the chord bars 154 also includes a pair of protruding cams or cam means 160 which cooperate and nest with the cam recesses 158 of the slide bars 152 when the chord bars 154 are in their inactive position as shown in FIG. 15. The chord bars 154 each include a plurality of fingers 162 depending from the edge of chord bar 154 distal from protruding cam or cam means 160.

Figure 8:
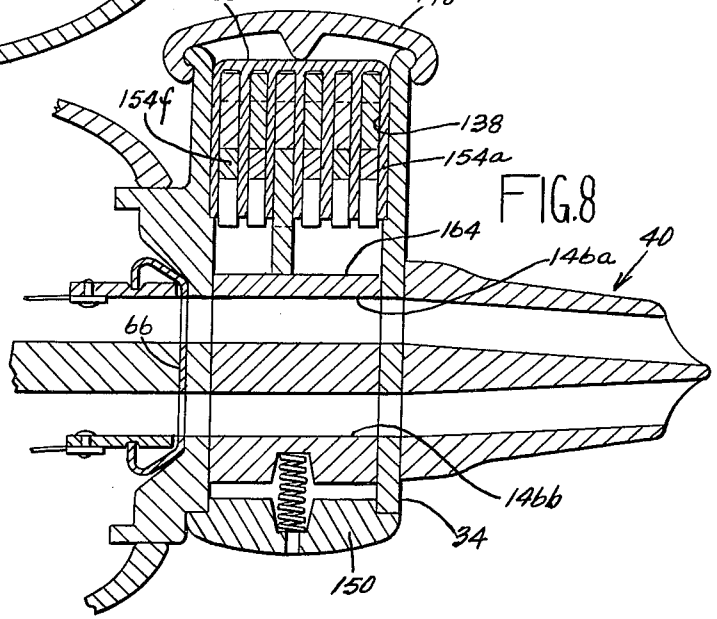
FIG. 8 is a partial cross-section taken substantially along the section line 8—8 of FIG. 1, showing the slide valve of FIG. 7 in an open position.

Referring now to FIGS. 8 and 15 and to FIGS. 17*a*–17*f*, the location of the fingers 162 on the chord bars 154 can be seen. The spacing of the fingers 162 is such that each of the fingers 162 contacts a finger surface 164 of one of the slide valves 102 and all of the fingers 162 on one of the chord bars 154 are positioned to open a plurality of the slide valves 102 according to a predetermined chordal pattern.

Figure 13:
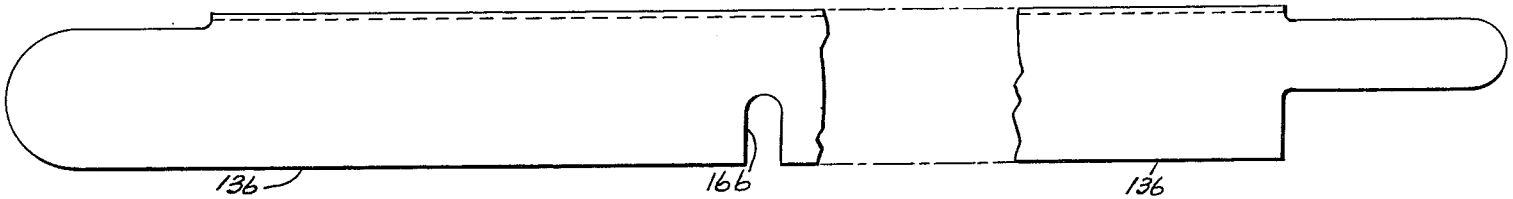
FIG. 13 is a front view of a portion of the retainer of FIG. 12.

Referring to FIGS. 13, 14, and 15, the retainer 136 is positioned in the cavity 134 against longitudinal movement therein by the cooperation of a locating notch 166 with a lug 168 (FIG. 15) of the valve block portion 34. The slide bars 152 are moved to their inactive positions as shown in FIG. 15 by a plurality of finger springs 170 which are each anchored in a plate 172 and which each bear on an end 174 of a slide bar 152 forcing a respective one of the slide bars 152 to the position as shown in FIG. 15 and forcing one of the cam arms 122 against a stop pad of plastic sponge material 176 and positioning one of the chord keys 36 to inactivated position 178 as shown in FIG. 14.

Referring now to FIGS. 14 and 16, one of the chord keys 36 has been actuated so that one of the key arms 118 thereof has been moved to activated position 180. Consequently, the connected one of the cam arms 122 has been moved to actuated position 182 wherein the cam arm 122 is against the stop pad 184, also of plastic sponge material, a slide bar 152 has been moved toward the right, deflecting one of the finger springs 170 as shown in FIG. 16. Movement of one of the slide bars 152 to the right has disengaged the previously mentioned nesting of the cam means 158 with the cam means 160 and has forced one of the slide bars 152 downward to a position wherein a plurality of the fingers 162 have engaged and actuated a plurality of the slide valves 102 to positions wherein the valve passages 146 of the slide valves 102 register with the passages 98 in the valve block portion 34. It should be noticed that each of the slide bars 152 is of such a length that they are restrained against longitudinal movement by the lug 168 and a similar lug 186 at the opposte end. The lugs 168 and 186 are an integral part of the valve block portion 34 and project up into the chord and slide bar cavity 134.

Referring now to FIG. 8 and FIGS. 17*a*–17*f*, the chord bars 154 are installed in the slots 138 with the chord bar 154*a* being in the slot 138 nearest the mouthpiece 40 and the other of the chord bars 154 being installed in the other of the slots 138 in alphabetical order according to the suffix letter of their part number designation.

Referring now to FIG. 16 and to FIGS. 17*a*–17*f*, the chord bars 154, listed in alphabetical order of their number suffixes, have the fingers 162 thereof spaced to produce major chords, sixth chords, minor chords, flatted seventh chords, augmented chords, and diminished chords. Since the FIGS. 17 are to scale and also the FIG. 16 is to scale, a comparison of the quantity of the fingers 162 and the location thereof for each of the FIGS. 17 with the spacing of the passages 98 and the slide valves 102 in FIG. 16 will enable one skilled in the art to determine the aforestated chordal patterns. In addition, since it has been stated that the first of each 12 spaces includes a passage 98 which comprises the keynote passage 100, one skilled in the art can use his knowledge of musical theory to determine the quantity and position of the fingers 162 in the absence of FIGS. 17.

Referring now to FIGS. 4, 5 and 18 but primarily to FIG. 18 the end plate 92, the keyblock 38 with a portion of the tone chamber body assembly 52 attached and a portion of the housing 32 are shown in exploded perspective.

The keyblock 38 includes six cylindrically shaped and vaulted keys 188 each having a key surface parallel to but at a different distance from the end 96 of the tone chamber body 54. When the tone chamber body 54 is in the spring-loaded position wherein the end 96 of the tone chamber body 54 is abutted against the end plate 92, as shown in FIG. 5, the tone chamber 194*a* is in registry with keynote passage 100*a;* and the C-note tone chamber 194*a* is the C-note for the lowest octave in the tone chamber body assembly 52 which is one actave below middle C. Thus, when none of the keys 188 are actuated, the body 54 is in a position wherein each of the four C-note tone chambers 194 register with one of the four keynote passages 100.

Referring again to FIG. 18, one of the six cylindrical keys 188, which projects through the end plate 92 at the lowest height, is the key for the note of D; and each of the successively higher of the keys 188 are for one full note higher in the chromatic scale.

The keyblock 38 also includes five vaulted or stepped keys 192 which have a shape that includes both a cylindrical and a rectangular box portion. The one of the keys 192 which protrudes through the plate 92 for the least distance is for the positioning of the tone chamber body assembly 52 to a position wherein the one of the tone chamber 56 which produces c#, a half step above the lowest C-note in the instrument, will be positioned to register with the keynote passage 100*a*. In like manner the successively higher of the keys 188 respectively position D#, F#, G#, and A#, tone chambers in registry with the keynote passage 100*a*.

Referring now to FIGS. 4 and 5, the tone chamber body 54 includes one C-note chamber 194*a* (FIG. 4) and a C-note chamber 194*d* which is four octaves above the C-note passage 194*a* (FIG. 5). Thus it can be seen that the tone chamber body assembly 52 includes three full octaves in the chromatic scale plus an additional uppermost C-note. In like manner, the valve block portion 34 includes the keynote passage 100*a* as shown in FIG. 4 and the keynote passage 100*d* as shown in FIG. 5. Thus the valve block portion 34 includes three groups of twelve spaces corresponding to the twelve spaces in the chromatic scale and a 37th space which is the keynote passage 100*d*.

Having described the construction of the apparatus in some detail, the apparatus comprises a plurality of tone-producing elements, a chordal pattern means, a keynote selection means, and a cross-indexing means. It can further be seen that the chordal pattern means comprises: a chord key mechanism having a pivot shaft 106, a plurality of torsion tubes 116, a plurality of key arms 118, a plurality of keys or chord keys 36, and a plurality of cam arms 122; a plurality of passages 98; a plurality of air valves or slide valves 102; and a cam mechanism having a plurality of slide bars 152 and a plurality of chord bars 154 which each include a plurality of fingers 162. Also the apparatus includes a keynote selection means which comprises keyblock 38 and stepped or vaulted keys 188 and 192. Finally, the apparatus includes cross-indexing means which comprises: the chromatic arrangement of the tone chambers 56, the spacing of the ports 64 leading to the tone chambers, the spacing of the passages 98, the chordal pattern or the arrangement of open passages, and the relative positioning and resulting registry of the tone chambers 56 with the passages 98.

The method of playing the apparatus will now be described. First, playing single tones, octaves, and chromatic runs: it will be recalled that there are four open or keynote passages 100 in the keyblock 38. Starting from the left, the passages 100 register with the C-note passages for one octave below middle C to two octaves above middle C when the keyblock 38 is not depressed and when the tone chamber body assembly 52 is abutted against the end plate 92. Sliding the keyblock 38 to any of eleven graduated stations, by moving one of the keys 188 or 192 to a position flush with the end plate 92, is effective to reposition the tone chamber body assembly 52 and to register the four of the tone chambers 56, which correspond to the one of the keys 188 or 192 that has been depressed, with the respective four keynote passages 100. Thus blowing air into or drawing air out of any of the four keynote passages 100 is effective to produce the tone or note corresponding to the one of the keys 188 or 192 which has been depressed and according to the octave of the keynote passage 100 into which air is blown into or drawn out of.

Playing in octaves is accomplished by increasing the mouth opening to cover two of the open or keynote passages 100 at once.

Chromatic runs in single notes or octaves is accomplished by blowing or drawing air continuously through one of the keynote passages 100 for single tones or through an adjacent pair of the keynote passages for octave tones.

Playing chords in the key of C is accomplished by manipulating one or two of the chord keys 36 while leaving the keyblock 38 in its spring-pressed position. The chord keys, enumerated from the mouthpiece of the instrument towards the rear, are as follows: major, sixth, minor flatted seventh, augmented, and diminished. The major, minor, augmented, and diminished chords are produced by depressing the first, third, fifth, or sixth of the chord keys 36 respectively. The fourth of the chord keys, the chord key 36*d*, is depressed simultaneously with the chord keys for the major, minor, augmented, and diminished chord keys for producing flatted seventh chords. To produce sixth chords, the chord key 36*d* is depressed simultaneously with either the major chord key 36*a* or the minor chord key 36*c*. Thus it can be seen that it is possible to play ten different chords in the key of C by depressing one or two of the chord keys 36.

Playing chords in the other keys is accomplished by actuating the tone chamber body assembly 52 to one of eleven positions by actuating one of the eleven keys 188 and 192. By depressing one of the keys 188 or 192, four of the tone chambers 56 are positioned to register with the four keynote passages 100 and also others of the tone chambers 56 are positioned to register with the ones of the passages 98 which correspond to the chordal pattern as determined by the chord keys that have been depressed. The result is that the selected chord may be played in the selected key in any of the three octaves.

Chord inversions may be played on the apparatus by depressing one or two of the chord keys 36 and thereby to select a chordal pattern by the opening of a plurality of the slide valves 102 and then by depressing one of the keys 188 or 192 and thereby positioning four of the tone chambers 56 in registry with the four keynote passages 100 and positioning a plurality of the other of the tone chambers 56 in registry with the pattern of the open slide valves 102 which corresponds to the chord key or keys that have been depressed and the chordal pattern that has been selected. Then the performer's mouth can be shaped to cover only one octave at a time and by positioning the mouth opening between octaves, the keynote for the chord to be played is dropped and the keynote in the next higher octave is added. Thus chords can be formed and carried through inversions in glissando by forming the correct mouth opening and by blowing or drawing continuously while sliding the harmonica back and fourth over one or two or more octaves.

The chord may be played in arpeggio form by restricting the mouth opening to one note or tone at a time and by blowing or drawing continuously while sliding the mouth back and fourth over the chordal pattern.

In like manner a chordal pattern can be carried through a chromatic ascent and descent by forming the mouth to cover one octave area and by blowing or drawing continually through this one octave area while smoothly sliding the keyblock from its C-position all the way into its B-note position. The result is that the initial sounding of a C chord is smoothly transposed to a C# chord and then to a D chord being followed by the other of the tones of the chromatic scale and stopping this chromatic ascent with a B-chord.

In summary it can be seen that the apparatus of the present invention produces 120 chords in a three-octave range; and 120 chords can be played in arpeggio or through inversions in glissando or carried through chromatic ascent or decent in glissando.

While there have been described above the principles of this invention in connection with specific apparatus, it is to be clearly understood that this description is made only by way of example and not as a limitation to the scope of the invention.

What is claimed is:

1. A musical sound-producing apparatus comprising a plurality of tone-producing elements for producing notes in a chromatic scale:

chordal pattern means for selecting one of a plurality of predetermined chordal patterns;

keynote selection means for manually selecting one note from said chromatic scale for the keynote of said chordal pattern;

cross-indexing means including said keynote selection means and said chordal pattern means for selecting a plurality of said elements to be actuated corresponding to said selected chordal pattern and said keynote, and for activating said selected elements;

said elements comprise a plurality of air-actuated tone chambers each producing one of said notes in said chromatic scale;

said chordal pattern means comprises a chord key mechanism, a plurality of passages, a plurality of air valves each being interposed into one of said passages for controlling air flow therethrough, and a cam mechanism operatively interconnecting said chord key mechanism and preselected pluralities of said air valves corresponding to said predetermined chordal patterns;

a housing; said chord key mechanism comprises a pivot shaft being attached to said housing, a torsion tube being rotatably fitted to said pivot shaft;

a key arm having one end thereof attached to said torsion tube orthogonally to the longitudinal axis of said pivot shaft and proximal to one end thereof, a chord key being provided on said key arm distal from said torsion tube, and a cam arm having one end thereof attached to said torsion tube orthogonal to the longitudinal axis of said pivot shaft and in spaced relationship to said key arm and having the other end operably connected to said cam mechanism to provide said interconnection of said chord key mechanism and said cam mechanism.

2. The apparatus of claim 1, in which said chord key mechanism further comprises:

a. a second torsion tube being larger in diameter and shorter in length than first said torsion tube, and being rotatably fitted over first said tube intermediate said key arm and said cam arm;

b. a second key arm having one end thereof attached to said second torsion tube proximal to first said key arm and orthogonal to said axis;

c. a second key being provided on said second key arm distal from said second key arm; and d. a second cam having one end thereof attached to said second torsion tube orthogonal to said axis and proximal to first said camming arm.

3. A musical sound-producing apparatus comprising a plurality of tone-producing elements for producing notes in a chromatic scale:

chordal pattern means for selecting one of a plurality of predetermined chordal patterns;

keynote selection means for manually selecting one note from said chromatic scale for the keynote of said chordal pattern;

cross-indexing means including said keynote selection means and said chordal pattern means for selecting a plurality of said elements to be actuated corresponding to said selected chordal pattern and said keynote, and for activating said selected elements;

said elements comprise a plurality of air-actuated tone chambers each producing one of said notes in said chromatic scale;

said chordal pattern means comprises a chord key mechanism, a plurality of passages, a plurality of air valves each being interposed into one of said passages for controlling air flow therethrough, and a cam mechanism operatively interconnecting said chord key mechanism and preselected pluralities of said air valves corresponding to said predetermined chordal patterns;

said chord key mechanism comprises a plurality of chord keys and said cam mechanism comprises:

a plurality of parallel-disposed and elongated slide bars each being slidably guided for longitudinal movement with respect to one elongated surface thereof, each including cam means on the opposite surface thereof, and each being operatively connected to one of said chord keys; and a plurality of parallel-disposed and elongated chord bars each including cam means on one elongated edge surface thereof, each having a plurality of fingers depending from the other elongated edge surface thereof in predetermined positions corresponding to one of said predetermined chordal patterns and the corresponding plurality of said air valves, each being mounted parallel to one of said slide bars with said cam means abutting and interacting, each being restrained against longitudinal movement, and each being slidably guided for movement orthogonal to said elongated surfaces.

4. A musical sound-producing apparatus comprising a plurality of tone-producing elements for producing notes in a chromatic scale:

chordal pattern means for selecting one of a plurality of predetermined chordal patterns;

keynote selection means for manually selecting one note from said chromatic scale for the keynote of said chordal pattern;

cross-indexing means including said keynote selection means and said chordal pattern means for selecting a plurality of said elements to be actuated corresponding to said selected chordal pattern and said keynote, and for activating said selected elements;

said elements comprise a plurality of air-actuated tone chambers each producing one of said notes in said chromatic scale;

said chordal pattern means comprises a chord key mechanism, a plurality of passages, a plurality of air valves each being interposed into one of said passages for controlling air flow therethrough, and a cam mechanism operatively interconnecting said chord key mechanism and preselected pluralities of said air valves corresponding to said predetermined chordal patterns;

an elongated valve block having an elongated indexing surface longitudinally disposed thereon:

said passages are orthogonally disposed to said indexing surface and are arranged in an elongated row;

said valve block includes a plurality of parallel-disposed valve cavities each intercepting one of said passages orthogonally to said indexing surface and to the longitudinal axis of said valve block; and said air valves comprise a plurality of slide valves each being slidably fitted into one of said valve cavities, each having both a position wherein said passage is occluded and a position wherein said passage is open to the flow of air, and spring means for urging said slide valves toward one of said positions.

5. The apparatus of claim 4 in which said valve block includes twelve equal passage spaces:

a. one of said passages is located in the first of said spaces, and the other of said passages is located in a predetermined pattern in the other of said spaces; said slide valve cavities intercept said other passages; and b. said air valves are interposed into said other passages.

6. The apparatus of claim 5 in which said other passages are located in the fourth, fifth, and eighth of said spaces.

7. The apparatus of claim 6 in which said other passages are additionally located in the seventh, ninth, tenth, and eleventh of said spaces.

8. The apparatus of claim 7 in which said valve block includes a second twelve spaces, and said passages and said air valves are located in said second twelve passages in the same relative spaces as in the said first twelve spaces.

9. A musical sound-producing apparatus comprising a plurality of tone-producing elements for producing notes in a chromatic scale:

chordal pattern means for selecting one of a plurality of predetermined chordal patterns;

keynote selection means for manually selecting one note from said chromatic scale for the keynote of said chordal pattern;

cross-indexing means including said keynote selection means and said chordal pattern means for selecting a plurality of said elements to be actuated corresponding to said selected chordal pattern and said keynote, and for activating said selected elements;

said elements comprise a plurality of air-actuated tone chambers each producing one of said notes in said chromatic scale;

an elongated and generally rectangular tone chamber body having one elongated surface thereof that comprises an indexing surface, and having said tone chambers disposed thereon:

said tone chambers each include a port opening orthogonally through said indexing surface in a row intermediate of the elongated sides of said one elongated surface;

said chordal pattern means includes an elongated valve block having a second elongated indexing surface on one side thereof, a plurality of spaced parallel passages opening orthogonally through said second indexing surface in a row intermediate of the elongated sides of said second indexing surface, a plurality of air valves each being interposed into one of said passages and each controlling the flow of air therethrough, and means for opening said air valves according to said predetermined chordal patterns; and said keynote selection means being operable to provide for the relative positioning of one of said indexing surfaces with the other of said indexing surfaces and the registry of one of said ports with one of said passages.

10. The apparatus of claim 9 in which said apparatus includes an elongated and generally rectangular box-type housing having one end thereof open and an elongated and generally rectangular body cavity therein, and having an elongated side adjacent to said open end that comprises said valve block and carries said second indexing surface on the inner surface thereof;

a. said tone chamber body is slidably fitted into said cavity with said indexing surfaces proximal to each other and resiliently urged into air-sealing engagement; and b. said keynote selection means comprises a keyblock attached to said tone chamber body and having a plurality of stepped key surfaces distal from said tone chamber body, distal from said housing, generally parallel to said open end, and being located at distances wherein one of said keynotes will be selected when any one of said stepped key surfaces is moved to a position wherein said one key surface is flushed with said one end.

11. The apparatus of claim 9 in which said cross-indexing means comprises the spacing of said ports in said first indexing surface, the spacing of said passages in said second indexing surface, said relative positioning of said indexing surfaces and said registry of said one port with said one passage by said keynote selection means, the resultant registry of the other of said ports with the other of said passages, and the opening of said air valves according to said predetermined chordal patterns.

12. A musical sound-producing apparatus comprising a plurality of tone-producing elements for producing notes in a chromatic scale:

chordal pattern means for selecting one of a plurality of predetermined chordal patterns;

keynote selection means for manually selecting one note from said chromatic scale for the keynote of said chordal pattern;

cross-indexing means including said keynote selection means and said chordal pattern means for selecting a plurality of said elements to be actuated corresponding to said selected chordal pattern and said keynote, and for activating said selected elements;

said elements comprise a plurality of air-actuated tone chambers each producing one of said notes in said chromatic scale;

an elongated and generally rectangular box-shaped housing having one end thereof open and having one elongated side thereof that comprises an elongated valve block which carries an elongated indexing surface on the inner surface of said housing, and an elongated and generally rectangular tone-chamber body being slidably fitted into said housing and having an elongated second indexing surface proximal to and in air-sealing engagement with said first indexing surface:

said tone-producing elements comprise a plurality of reed-type tone chambers being disposed in an elongated row in said tone chamber body and including a plurality of ports opening orthogonally through said second indexing surface in an elongated row;

said chordal pattern means comprises a chord key mechanism, a plurality of passages being parallel-disposed in an elongated row orthogonal to and opening through said first indexing surface, a plurality of air valves being interposed into said valve block in an elongated row and each intercepting one of said passages to control the flow of air therethrough, and a cam mechanism operatively interconnecting said chord key mechanism and preselected pluralities of said air valves corresponding to said predetermined chordal patterns;

said keynote selection means being operable to provide for the relative positioning of one of said indexing surfaces with the other of said indexing surfaces and the registry of one of said ports with one of said passages; and said cross-indexing means comprises the spacing of said passages in first said indexing surface, the spacing of said ports in second said indexing surface, said relative positioning of said indexing surfaces and said registry of said one port with said one passage, the resultant registry of other of said ports with other of said passages, and said opening of said air valves according to said predetermined chordal pattern.

13. The apparatus of claim 12 in which said apparatus includes a second row of reed-type tone chambers being disposed in an elongated row parallel to first row of tone chambers, both of said rows of tone chambers being disposed in chromatic scale arrangement, one of said rows of tone chambers producing sound when air is supplied to the reeds thereof from said ports and the other of said rows of tone chambers producing sound when air is drawn into the tone chambers thereof by suction applied to said ports:

a. said apparatus includes a spring device being interposed between said housing and the elongated side of said tone chamber that is distal from and substantially parallel to said second indexing surface, and being effective to resiliently urge said indexing surfaces into said air-sealing engagement;

b. said air valves each comprise a slide type valve being slidably disposed in said valve block orthogonal to said passages and to said first indexing surface, each being spring-loaded to a passage-occluding position, and each providing a finger surface for actuation to a passage-open position, each having a helical compression spring engaged therewith to provide said spring-loading;

said cam mechanism comprises an elongated chord bar being parallel-disposed to said valve block and to said finger surfaces and having cam means on the elongated surface thereof distal from said finger surfaces and fingers depending from the elongated surface thereof proximal to said finger surfaces in spaced relationship to engage said finger surfaces according to one of said predetermined chordal patterns, an elongated slide bar with one elongated surface thereof in sliding contact with said distal surface of said chord bar and having cam means on said sliding surface disposed to cooperate with said first cam means, and guide means with slots for guiding said slide bar in elongated sliding contact with said chord bar and for guiding said chord bar for movement toward said finger surfaces;

d. said chord key mechanism comprises a pivot shaft being attached to said housing distal from said open end and orthogonal to said first indexing surface, a torsion tube being rotationally fitted to said pivot shaft, a key arm having one end thereof attached orthogonally to the longitudinal axis of said pivot shaft and distal from the end thereof proximal to said first indexing surface, a chord key being provided on said key arm distal from said torsion tube, and a cam arm having one end thereof attached orthogonally to the other end of said torsion tube and having the other end thereof operatively connected to said slide bar; and e. said keynote selection means and said relative positioning of said indexing surfaces comprises a spring being interposed between the inner surface of said housing distal from said open end and said tone chamber body and resiliently urging said body toward said open end, and a keyblock being attached to said tone chamber body and having a plurality of stepped keys parallel to and distal from said tone chamber body.

14. The apparatus of claim 13 in which said second row of tone chambers opens orthogonally through said second indexing surface in a row parallel to said first row of ports:

a. said valve block includes a second row of parallel-disposed passages opening orthogonally through said first indexing surface in a row parallel to said first row of passages and in registering opposition to said second row of ports;

b. each of said slide valves additionally intercepts and controls air flow through one passage of said second row opening one passage of both rows when said finger surface is moved in opposition to said spring loading;

c. said cam mechanism includes a plurality of additional chord bars being disposed in parallel relationship to said first chord bar and each having both cam means on the surfaces thereof distal from said finger surfaces and a plurality of fingers depending from the elongated surface thereof proximal to finger surfaces and engaging predetermined pluralities of said finger surfaces, a plurality of additional slide bars each being in elongated sliding engagement with one of said additional chord bars and each having cam means on the elongated surface thereof proximal to the engaged one of said chord bars, each slide bar having a spring engaged therewith biasing it longitudinally to its unactuated position;

d. said chord key mechanism comprises a plurality of additional torsion tubes each being of a different diameter and a different length, all being coaxially mounted over a first said torsion tube for rotational movement thereon, each including a key arm and a chord key affixed to one end thereof, and each including a cam arm affixed to the other end thereof and operatively connected to one of said additional slide bars;

e. said housing includes an end plate being attached in parallel engagement to said open end and having an opening therethrough that premits movement of said keyblock into said housing and that prohibits movement of said body out of said housing;

f. said stepped keys of said keyblock are disposed at heights wherein the movement of any one of said stepped keys to a position flush with said end plate provides one of said keynotes;

g. said spring device comprises a plurality of leaf springs each having one end thereof attached to said body, and a plurality of wheels each being rotationally attached to the other end of one of said springs and each engaging said housing for rolling movement as said indexing surfaces are positioned by movement of said keyblock; and h. said keyblock includes a mouthpiece surface with an elongated row of openings therethrough which each register with one of said passages.

15. A player controlled musical sound producing apparatus comprising a plurality of selectable tone-producing elements for producing notes in a musical scale;

a plurality of separate, player manipulable chordal members;

a plurality of player manipulable key members;

first means for setting a predetermined chordal combination of said tone-producing elements upon actuation of each of said chordal members, said predetermined chordal combinations being different one from the other;

second means for setting a predetermined key combination of said tone-producing elements upon actuation of each of said key members, said predetermined key combinations being different one from the other; and third means for superimposing said chordal combination on said key combination before or during actuation of said tone-producing elements and superimposing said key combination on said chordal combination before or during actuation of said tone-producing elements for obtaining a corresponding resultant combination of operable tone-producing elements whereby upon operation of said tone-producing elements, a sound corresponding to said resultant combination will be produced.

16. The apparatus of claim 15 with each of said chordal members comprising an individually depressible finger tab having a first position and depressible to a second position to set the chordal combination for that particular finger tab; and each of said finger tabs being spring-urged to said first position and returned to said first position upon finger release of said tabs.

17. The apparatus of claim 15 with a housing for supporting said tone-producing elements;

an elongated slide being mounted in said housing for sliding movement along the longitudinal slide axis;

a positioning member being in relatively fixed position to said housing;

said plurality of player manipulable key members comprising a plurality of exposed finger steps on said slide, each of which is separately finger engageable;

said slide being spring urged to a first longitudinal position and being finger positionable to a longitudinal position corresponding to each of said finger steps; and said slide position for a given finger level being determined by finger positioning said given finger step against said positioning member, said slide returned to said first position upon finger release from said finger step.

18. A player controlled sound producing musical apparatus comprising:

a plurality of selectable tone-producing elements for producing notes in a musical scale;

means for receiving tone-producing actuation to sound tones in said tone-producing elements;

a slide member slidably related to said means and having a plurality of positions to move predetermined combinations of said tone-producing elements relative said means for sounding tones in different predetermined keys when actuated;

a plurality of player accessible key steps for positioning said slide member, each key step when player actuated moving said slide member to a single predetermined position for setting said tone-producing elements for a predetermined key; whereby upon actuation of said tone-producing elments a sound corresponding to the setting of said elements by said slide member will be produced.

19. Apparatus according to claim 18 with a housing for supporting said tone-producing elements;

a positioning member being in relatively fixed position to said housing;

said key steps formed integrally on said slide member; and said slide member spring urged to a first position and player positionable to a corresponding additional position by each of said steps; and said slide position corresponding to a given step being determined by positioning of said given step proximal to said stop, said slide returned to said first position upon release from said finger step.

20. A method of producing musical chord sounds from tone-producing elements comprising the steps of:

manually actuating one of a plurality of independently actuable chordal members to obtain a predetermined chordal setting of tone-producing elements corresponding to the member actuated, said predetermined settings being different one from the other;

manually actuating one of a plurality of key members to obtain a predetermined key setting of the tone-producing elements corresponding to the key member actuated; said manual actuations and settings of said chordal and key members being superimposable on one another and selectively actuating said tone-producing elements that have previously been set by said key members and said chordal members to produce a tone pattern corresponding thereto.

21. The method of claim 20 with the step of manually actuating one of a plurality of key members comprising manually sliding the key members to a predetermined position.

22. The method of claim 20 with said step of actuating said tone-producing elements comprising blowing or drawing an air volume against said tone-producing elements.

* * * * *